United States Patent [19]

Dumas

[11] Patent Number: 4,813,253

[45] Date of Patent: Mar. 21, 1989

[54] SAFETY LOCKING DEVICE FOR AN ARTICLE, IN PARTICULAR LUGGAGE, AND AN INSTALLATION INCLUDING SAID DEVICE

[75] Inventor: Jean-Louis F. Dumas, Paris, France

[73] Assignee: Hermes, Paris, France

[21] Appl. No.: 931,581

[22] Filed: Nov. 14, 1986

[30] Foreign Application Priority Data

Nov. 14, 1985 [FR] France ..... 85 16858

[51] Int. Cl.[4] ..... E05B 65/52

[52] U.S. Cl. ..... 70/69; 70/84; 70/137; 70/70; 70/72; 70/74; 70/76

[58] Field of Search ..... 70/69–76, 70/78, 84, 137; 292/227

[56] References Cited

U.S. PATENT DOCUMENTS

| | | | |
|---|---|---|---|
| 586,780 | 7/1897 | Petgen | 70/69 X |
| 845,931 | 3/1907 | Davenport | 70/70 X |
| 1,585,799 | 5/1926 | Stone | 70/70 |
| 2,001,805 | 5/1935 | Wheary | 70/70 |
| 2,161,519 | 6/1939 | Loftin et al. | 70/70 X |
| 2,399,302 | 4/1946 | Thiele | 70/70 |
| 2,426,754 | 9/1947 | Thiele | 70/70 |
| 2,820,359 | 1/1958 | Levine | 70/69 |
| 3,003,348 | 10/1961 | Jacobi | 292/227 X |
| 3,100,980 | 8/1963 | Humphries | 70/71 |
| 3,183,691 | 5/1965 | Gehrie | 70/70 |
| 3,206,953 | 9/1965 | Atkinson | 70/70 |
| 3,391,553 | 7/1968 | Nerrenberg-Sudhaus | 70/70 |
| 3,392,556 | 7/1968 | Atkinson | 70/71 |
| 3,402,578 | 9/1968 | Atkinson | 70/70 |
| 3,412,832 | 11/1968 | Jamison et al. | 70/69 X |
| 3,500,667 | 3/1970 | Jespersen . | |

FOREIGN PATENT DOCUMENTS

| | | | |
|---|---|---|---|
| 825222 | 7/1949 | Fed. Rep. of Germany | 70/69 |
| 1428521 | 11/1968 | Fed. Rep. of Germany | 70/69 |
| 745682 | 2/1975 | France . | |

*Primary Examiner*—Robert L. Wolfe
*Assistant Examiner*—Suzanne L. Dino
*Attorney, Agent, or Firm*—Wenderoth, Lind & Ponack

[57] ABSTRACT

A closing device includes a keeper provided with a retaining element for retaining a bolt in the keeper in a closed position of the device. The retaining element is mounted to be pivotable about and to be axially movable on a rod provided in the keeper and is resiliently biased to both axially slide on and pivot about the rod in such manner that, in an active position, the retaining element projects into an extension of an opening into which the bolt is capable of entering so as to close the device, and it is brought to a retracted position by axially sliding along the rod while being automatically returned to its active position from its retracted position as soon as the bolt is extracted from the keeper under the effect of the resilient force exerted by a spring.

15 Claims, 2 Drawing Sheets

SAFETY LOCKING DEVICE FOR AN ARTICLE, IN PARTICULAR LUGGAGE, AND AN INSTALLATION INCLUDING SAID DEVICE

BACKGROUND OF THE INVENTION

The present invention relates to closing devices in particular for luggage, adapted to immobilize two elements at least one of which is movable relative to the other, comprising a bolt adapted to be mounted on one of said elements and a keeper adapted to be mounted on the other element, the keeper including retractable means for retaining the bolt in the closed position of the device.

Closing devices for luggage of the aforementioned type are known, which comprise a latch, commonly known as a clasp, fixed to the lid of the luggage and a keeper fixed to the part of the luggage which defines its inner volume. The clasp is provided with a loop which, in the closed position, is introduced into the opening of the keeper where it is retained by a pin which is combined with this keeper and extends through the loop.

Such device is opened conventionally by means of a button which causes the pin to be withdrawn from the loop, the clasp being associated with resilient means which automatically extracts the loop from the keeper as soon as the pin has been retracted.

In order to close the luggage, the user must first of all swing over the lid and then introduce, by exerting a pressure on the clasp, the loop into the opening of the keeper, the pin provided in the latter resiliently withdrawing under the effect of the pressure exerted by the introduction of the loop so as to retain it as soon as it is introduced into the keeper and thus close the device.

The opening and closing of luggage with such a device therefore require various operations which comprise, on one hand, acting on the control means for releasing the clasp and, on the other hand, swinging over the lid and then the clasp so as to force the loop carried by the clasp into the keeper.

SUMMARY OF THE INVENTION

An object of the invention is to overcome this drawback by providing a closing device in which the number of operations required for effecting the opening and closing, for example of the luggage on which it is mounted, is very small.

The invention therefore provides a locking device for relatively immobilizing two elements of which one is movable relative to the other, comprising a bolt adapted to be mounted on one of the elements and a keeper adapted to be mounted on the other element, the keeper comprising a retractable retaining element provided with means for hooking the bolt, and a control element. The retaining element is mounted to be slidable along an axis between armed and unarmed positions in opposition to the action of a resilient return element axial biasing the retaining element to the armed position. The retaining element, when it is moved to the unarmed position, pivoted about the axis under the action of the resilient return element. The bolt, so long as it is located in the keeper, constitutes an axial abutment means for retaining element to maintain the same in the unarmed position. After the pivoting of the retaining element about the axis, then when the bolt is disengaged from the keeper, the retaining element automatically returns to the armed position.

The invention also provides an article, in particular luggage, comprising two body parts, said article further comprising at least one closing device such as defined hereinbefore, each bolt being mounted on one of said body parts, and each keeper being respectively mounted on the other body part.

According to another feature of the luggage, there is provided, on at least one part of the periphery of the corresponding edge of at least one of said body parts, an elastically yeildable element adapted to be elastically compressed upon the closure of the, or each, closing device.

The invention further comprises a closing installation, in particular of a building opening, comprising a panel mounted to be slidable in a direction but roughly parallel to a second panel, wherein there is provided at least one closing device as defined hereinbefore, each bolt being mounted on one of said panels and each associated keeper being mounted on the other of said panels.

BRIEF DESCRIPTION OF THE DRAWINGS

A better understanding of the invention will be had from the following description of an embodiment which is given by way of example with reference to the accompanying drawings, in which.

DETAILED DESCRIPTION OF THE INVENTION

Figure 1:
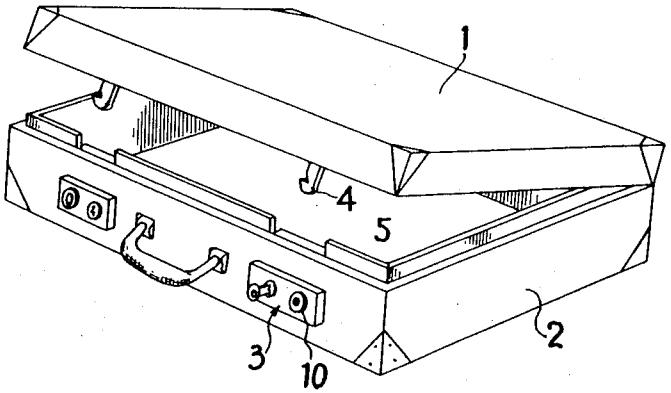
FIG. 1 is an assembly perspective view of a partially open small case provided with two closing devices according to the invention.

The small case, e.g. attaché-case, illustrated in FIG. 1, comprises a lid 1 hinged to a part 2 which defines the inner volume of the case. On the side of the case opposed to that on which the lid 1 and the part 2 are hinged together, two closing devices according to the invention are each disposed in the vicinity of one end of this side of the case.

FIG. 1 shows that each closing device comprises a keeper 3 mounted on the part 2 of the case and a bolt 4 mounted inside the lid 1 of the case by two screws **4*a* (FIG. 3), this bolt being adapted to enter an opening 5 in the associated keeper 3** when the device is closed.

Each keeper 3 further comprises a housing 6, defining the opening 5, fixed inside the case, and a front plate 7 fixed to the outside of the case by three screws **8*a* which extend, through the housing 6 and the corresponding wall of the part 2 of the case and are screwthreadedly engaged in tapped studs 8 (FIG. 2) so that the housing 6 and the associated front plate 7** are fixed together.

It will be observed that each closing device is provided with opening means for controlling the opening of this device in the form of a push-button 9, which extends, in the closed position of the device, through the inner end of a cavity 10 provided in front plate 7 and projects outside the case.

In order to be able to lock each closing device in the closed position, each front plate 7 is provided with a barrel lock 11 located in the vicinity of the cavity 10.

Figure 2:
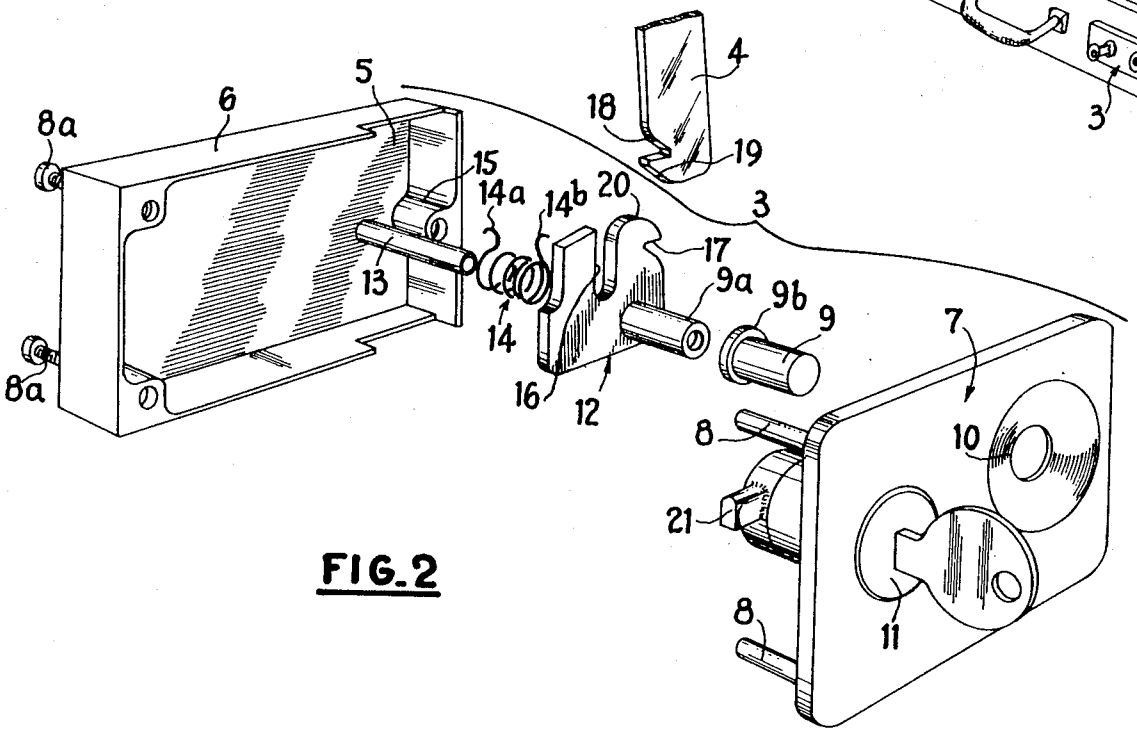
FIG. 2 is an exploded perspective view, to an enlarged scale, of the closing device of the invention.
Figure 3:
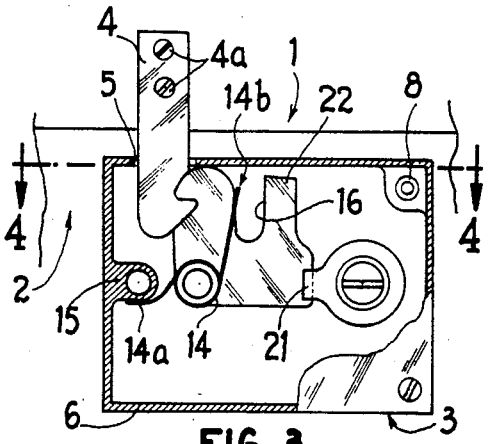
FIG. 3 is an elevational view, with a part cut away and to an enlarged scale, of a closing device of FIG. 1, as seen from the interior of the case, this device being in the closed and locked position.
Figure 5:
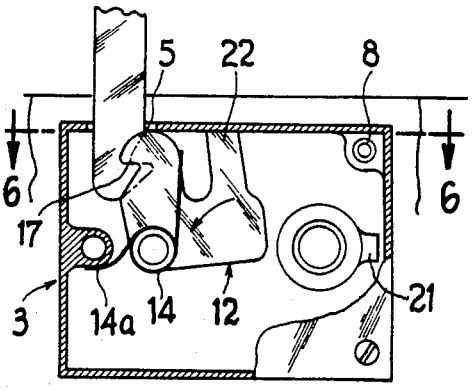
FIG. 5 is a view similar to FIG. 3, the device being unlocked and a retaining means of the device being in a retracted or unarmed position behind a bolt.

Reference will now be made more particularly to FIGS. 2, 3 and 5 in which the internal structure of the keeper 3 is illustrated in detail.

The push-button 9 is in the form of a tube closed at its outer end. This button is mounted to be rotatable and movable axially in translation on a sleeve 9*a* carried by an element 12 for retaining the associated bolt 4. The botton 9 is moreover provided at its inner end, in the vicinity of the retaining element 12, with an annular flange 9*b* which extends radially outwardly, this annular flange 9*b* being adapted to abut against the periphery of the orifice which is provided in the inner end of the cavity 10 and through which the push-button extends, so that the latter cannot be separated from the keeper 3 by pulling on the part thereof which projects out of the keeper.

Figure 7:
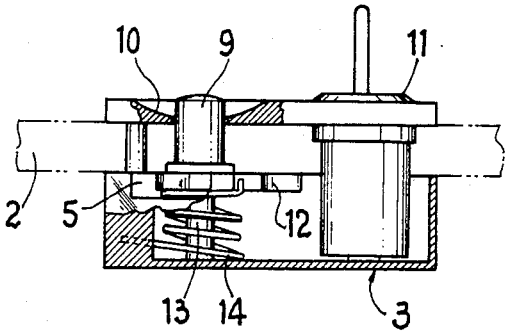
FIG. 7 is a view similar to FIGS. 4 and 5, the retaining means being in an active or armed position in the open device.

The sleeve 9*a* and the retaining element 12 are mounted to be pivotable and axially slidable in translation on a rod 13 provided inside the housing 6, this rod extending through the retaining element 12 so that the rod 13, the sleeve 9*a* and the push-button 9 are in alignment on a common axis. A coil spring 14 is mounted around the rod 13 between the retaining element 12 and the neighboring wall of the housing 6. This spring 14 is mounted, on one hand, to be axially compressed so as to axially bias the retaining element 12 and the sleeve 9*a* toward the front plate 7 and, on the other hand, to be put under torsional stress so as to pivotally bias the retaining element 12 to an active or armed position in the extension of the opening 5 (FIG. 7).

In order to put the spring 14 under torsional stress, one end 14*a* of the spring is retained by an inner boss 15 on the housing 6 through which boss a screw for fixing the keeper extends, the other end 14*b* of the spring being inserted in a slot 16 provided in the retaining element 12 and bearing against an edge of this slot.

In order to allow the retaining element 12 and the associated bolt 4 to positively cooperate in the closed position of the device, the retaining element 12 and the bolt 4 are each provided with a hook, respectively 17,18, adapted to fit one inside the other (FIG. 3) when the case is closed.

The bolt 4 and the retaining element 12 are also each provided with a cam, respectively 19, 20, these cams being adapted to provoke, when they cooperate with each other, the pivoting of the retaining element 12 about the axis of the rod 13 when the bolt 4 is inserted in the keeper 3, so as to ring the hooks 17 and 18 to a position in which they fit one inside the other and thus close the device.

The inner end of the barrel lock 11 is provided with a lug 21 which is adapted to be placed, when the barrel is rotated by a key, behind the retaining element 12 so as to lock the device against opening by preventing axial sliding of the retaining element 12 to its unarmed position.

The arrangement of the push-button, which is rotatable on the sleeve 9*a*, advantageously prevents, when the locking device is locked by the lug 21 disposed behind the retaining element 12, the pivoting of the latter and consequently the separation of the hooks 17 and 18, and the release of the bolt 4, should the part of the button 9 projecting out of the keeper be rotated.

The various steps in the operation of the closing device according to the invention will now be described, with reference to FIGS. 3 to 7.

Figure 4:
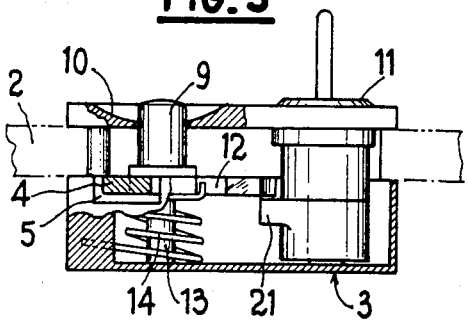
FIG. 4 is a sectional view taken on line 4–4 of FIG. 3.

In the closed position of the device (FIGS. 3 and 4), the bolt 4 is inserted into the keeper 3 through the opening 5 of the latter and the hook 17 of the retaining element is engaged in the hook 18 provided at the corresponding end of the bolt 4 so as to retain the latter and maintain the device closed. In this armed position, the lug 21 of the barrel lock 11 may be interposed between the housing 6 and the retaining element 12, as illustrated in FIG. 4, so as to prevent in this way any axial sliding of the push-button 9. It will be observed that, in this position in which the retaining element 12 is in the armed position, the length of the push-button 9 and the depth of the cavity 10 are such that the button does not project beyond the cavity 10 of the front plate 7 so that this push-button, notwithstanding the fact that it presents a projecting portion capable of being depressed by the user, is completely within the volume of the cavity 10 and there is therefore no danger of the button being accidentally caught on an object.

Figure 6:
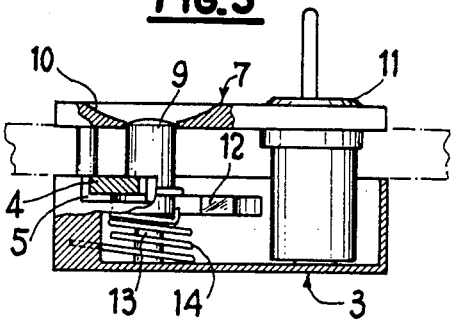
FIG. 6 is a sectional view taken on line 6—6 of FIG. 5.

The device according to the invention is opened in two steps, respectively illustrated in FIGS. 5, 6 and 7.

In the first step, the user unlocks the device (if the latter has been locked) by rotating the barrel lock 11 and axially depresses the push-button 9 in opposition to the reaction force exerted by the spring 14 in the axial direction of the rod 13. The depression of the button 9 causes the retaining element 12 to slide along the rod 13 toward its unarmed position in which the hooks 17 and 18 of retaining element 12 and the bolt 4 are axially separated from each other. The retaining element 12, which then extends between the bolt 4 and the neighbouring wall of the housing 6 (FIGS. 5 and 6), is made to pivot in the direction of the bolt (i.e. in the counterclockwise direction as viewed in FIG. 5) by the torsional force exerted by the spring 14 and is disposed in the thus retracted and unarmed position between the bolt 4 and the neighbouring surface of the housing 6 of the keeper. Retaining elements 12 is held in abutting relation against the bolt 4 in by the axial force exerted by the spring 14, and the torsional force exerted by spring 14 causes a, and being in abutting relation by a portion 22 (FIG. 5) of the retaining element 12 to be adjusted against the housing 6. The travel of the push-button 9 into the keeper 3 for bringing the retaining element 12 to its unarmed retracted position is such that push-button 9 is itself fully depressed into the keeper 3 (FIG. 6) so as to no longer project from the inner end of the cavity 10 of the front plate 7. Further, push-button 9 will remain in this depressed position as long as retaining element 12 is in its unarmed retracted position. Cavity 10 has a roughly spherical dome shape, which is advantageously adpated to the end of a finger of a user when the user depresses the push-button in order to open his case.

When this retracted or unarmed position of the retaining element 12 is reached, the bolt 4 can then be freely extracted from the keeper 3 by raising the lid 1 of the case. The extraction of the bolt 4 then eliminates the axial abutment for the spring 14 which therefore simultaneously returns the retaining element 12 to its active position (FIG. 7) as soon as the bolt has left the keeper.

In this active position, the hook 17 of the retaining element projects into the extension of the opening 5 of the keeper 3, the retaining element is held in axial abutment against the corresponding wall of the part 2 of the case by the axial force of spring 14, and the retaining element is pivoted angularly by the torsional force of spring 14 so that abutment portion 22 abuts against housing 6 of the keeper 3.

When this active position of the retaining element 12 is reached (FIG. 7), the device may again be closed merely by closing the lid 1 of the case, which causes the bolt 4 to enter the opening 5 of the corresponding keeper 3 of the closing device. When the bolt 4 enters the keeper, the cam 19 on the bolt slides along and cooperates with the cam 20 on the retaining element 12 which is thus caused to pivot on the rod 13 of the keeper in oposition to the action of the angular torsional force exerted by the spring 14 until the hooks 17 and 18 respectively provided on the retaining element and the bolt 4 are caused to engage each other, under the effect of the this same torsional force exerted by the spring 14 (FIGS. 3 and 4).

The closing device of the invention advantageously permits, owing to the arrangement of its retaining means and the control element, an easy operation for opening and closing, for example, the luggage on which it is mounted. Indeed, to achieve this opening, it is sufficient to merely depress the push-button so as to disarm the retaining means, which remains in such unarmed position until the luggage is actually opened, the fact of swinging down the lid and thus causing the bolt to enter the corresponding keeper automatically resulting in the closure of the device and therfore of the luggage. The opening of the latter then may be achieved with only one hand in two stages and its closure is achieved with one hand in one stage.

In order to still further simplify the operations on each closing device so as to open the luggage and reduce them to a single operation effected with only one hand, it may be arranged that at least one part of the corresponding peripheral edge of the lid and/or of the part 2 of the case associated with the device of the invention be provided with an elastically yieldable element, for example of elastomer, adapted to be compressed between the lid 1 and the part 2 in the closed position of the case so that, as soon as the user disarms the retaining element 12 of each device of the invention provided on the case, the latter is automatically partly opened and causes each bolt 4 to be extracted from the associated keeper 3 under the effect of the elastic extension tension of the elastic element, so that the user has no need to raise the lid 1 in order to extract the, or each, bolt 4 from the corresponding keeper.

Although the invention has been described with respect to a case whose two body parts, which are hinged together, are adapted to be relatively immobilized by means of closing devices of the invention, the latter may be used generally for relatively, immobilizing any two elements, at least one of which is movable relative to the other.

Thus, the closing device according to the invention may be applied to any article comprising two body parts hinged together, or at least one of which is mounted to be slidable in a direction roughly parallel to the other, such as luggage, in particular a suit case or a trunk, or a piece of furniture, for example a piece of furniture having at least one flexible or rigid panel which is slidable to close an opening. The or each bolt provided is mounted in the vicinity of an edge of a first panel and the, or each, corresponding keeper is mounted in the vicinity of the corresponding edge of a second panel in such manner that, by a sliding of the, or each, panel for closing the opening, each keeper cooperates with the associated bolt for relatively immobilizing these two panels.

Some pieces of furniture whose opening is adapted to be closed by one or two slidable screens, in particular a desk, may also be provided with at least one locking device for immobilizing the, or each, screen in its closed position. In these articles, an elastically yieldable sealing element or like elastic means may be provided on the corresponding edge of at least one of the panels or screens so as to automatically partly separate the latter when the or each closing device is opened.

Although the invention relates to the aforementioned articles, it also concerns closing installations, in particular for an opening of a building separating two premises of the latter comprising a flexible or rigid panel mounted to be slidable in a direction roughly parallel to another flexible ridge panel and optionally itself mounted to be slidable in a direction roughly parallel to the first panel.

As described before, the, or each, bolt of the closing device is mounted in the vicinity of an edge of a panel and the, or each, corresponding keeper is mounted in the vicinity of the corresponding edge of the second panel so that, by a sliding of the, or each, panel, each keeper cooperates with the respective bolt so as to relatively immobilize these panels. An elastically yieldable sealing element or other like means may be moreover provided on the corresponding edge of at least one of the panels so as to automatically partly separate them when the, or each, locking device is opened.

What is claimed is:

1. A closing device for relatively immobilizing two elements one of which is movable relative to the other between closed and open positions, said closing device comprising:

a bolt to be mounted on a first of the elements;

a keeper to be mounted on a second of the elements;

said keeper including hook means for hooking engagement with said bolt when the two elements are in the closed position and said bolt extends into said keeper;

said keeper including a retaining element having said hook means and mounted for axial movement along an axis between an armed position whereat said hook means may be engaged by said bolt, and an unarmed position, whereat said hook means may not be engaged by said bolt, and said retaining element also being mounted for pivotal movement about said axis;

said keeper including resiliently yieldable means for biasing said retaining element axially of said axis toward said armed position and for pivotally biasing said retaining element about said axis in a direction such that said hook means is urged toward and beyond a position of hooking engagement with said bolt, such that when said retaining element is in said armed position and the two elements are in the closed position said hook means engages with said bolt; and opening control means, mounted on said keeper, for selectively moving said retaining element axially along said axis against the axial biasing force of said resiliently yieldable means from said armed position to said unarmed position, and thereby for moving said hook means out of engagement with said bolt, whereupon the pivotal biasing force of said resiliently yieldable means pivots said retaining element in said direction about said axis, such that with the two elements in the closed position said bolt extending into said keeper forms a stop abutted by said retaining element under said axial biasing force of said resiliently yieldable means and maintaining said retaining element in said unarmed position, and such that upon movement of the two elements to the open position said bolt is withdrawn from said keeper and from abutment with said retaining element and said axial biasing force of said resiliently yieldable means moves said retaining element axially along said axis to said armed position.

2. A device as claimed in claim 1, wherein said retaining element includes means for angularly limiting the extent of pivotal movement in said direction of said retaining element about said axis.

3. A device as claimed in claim 1, wherein said resiliently yieldable means comprises a coil spring mounted about said axis under axial compression and torsional stress.

4. A device as claimed in claim 1, wherein said opening control means comprises a push button extending from said keeper when said retaining element is in said armed position.

5. A device as claimed in claim 4, further comprising a rod fixed to sai keeper and defining said axis, and a sleeve connected to said retaining element and movable therewith on said rod, said push button being rotatably mounted on said sleeve.

6. A device as claimed in claim 4, wherein said keeper includes a wall having an outer surface having therein a cavity having at an inner end thereof an aperture through said wall, said push button extending through said aperture and having a length such that when said retaining element is in said armed position said push button does not project from said cavity.

7. A device as claimed in claim 1, further comprising lock means on said keeper for locking said retaining element in said armed position and for preventing said opening control means for moving said retaining element to said unarmed position.

8. A device as claimed in claim 7, wherein said lock means comprises a lock unit having a locking lug movable to a locking position blocking axial movement of said retaining element to said unarmed position.

9. A device as claimed in claim 1, wherein said axis is defined by a fixedly positioned member.

10. An article, particularly an article of luggage, comprising two elements relatively movable between closed and open positions, and at least one closing device for maintaining said two elements in said closed position, said closing device comprising:

a bolt mounted on a first said element;

a keeper mounted on a second said element;

said keeper including hook means for hooking engagement with said bolt when the two elements are in said closed position and said bolt extends into said keeper;

said keeper including a retaining element having said hook means and mounted for axial movement along an axis between an armed position whereat said hook means may be engaged by said bolt, and an unarmed position, whereat said hook means may not be engaged by said bolt, and said retaining element also being mounted for pivotal movement about said axis; said keeper including resiliently yieldable means for biasing said retaining element axially of said axis toward said armed position and for pivotally biasing said retaining element about said axis in a direction such that said hook means is urged toward and beyond a position of hooking engagement with said bolt, such that when said retaining element is in said armed position and said two elements are in said closed position said hook means engages with said bolt; and opening control means, mounted on said keeper, for selectively moving said retaining element axially along said axis against the axial biasing force of said resiliently yieldable means for said armed position to said unarmed position, and thereby for moving said hook means out of engagement with said bolt, whereupon the pivotal biasing force of said resiliently yieldable means pivots said retaining element in said direction about said axis, such that with said two elements in said closed position said bolt extending into said keeper forms a stop abutted by said retaining element under said axis biasing force of said resiliently yieldable means and maintaining said retaining element in said unarmed position, and such that upon movement of said two elements to said position said bolt is withdrawing from said keeper and from abutment with said retaining element and said axial biasing force of said resiliently yieldable means moves said retaining element axially along said axis to said armed position.

11. An article as claimed in claim 10, further comprising an elastically yieldable element on at least one portion of a periphery of an edge of one of said elements, said elastically yieldable element being elastically compressed when said two elements are in said closed position.

12. An article as claimed in claim 10, wherein said axis is defined by a fixedly positioned member.

13. A closing installation, particularly for a building, comprising a first panel and a second panel mounted for movement in directions substantially parallel to said first panel between closed and open positions, and at least one closing device for maintaining said second panel in said closed position, said closing device comprising:

a bolt mounted on one of said panels;

a keeper mounted on the other of said panels;

said keeper including hook means for hooking engagement with said bolt when said second panel is in said closed position and said bolt extends into said keeper;

said keeper including a retaining element having said hook means and mounted for axial movement along an axis between an armed position whereat said hook means may be engaged by said bolt, and an unarmed position, whereat said hook means may not be engaged by said bolt, and said retaining element also being mounted for pivotal movement about said axis;

said keeper including resiliently yieldable means for biasing said retaining element axially of said axis toward said armed position and for pivotally biasing said retaining element about said axis in a direction such that said hook means is urged toward and beyond a position of hooking engagement with said bolt, such that when said retaining element is in said armed position and said second panel is in said closed position said hook means engages with said bolt; and opening control means, mounted on said keeper, for selectively moving said retaining element axially along said axis against the axial biasing force of said resiliently yeildable means from said armed position to said unarmed position, and thereby for moving said hook means out of engagement with said bolt, whereupon the pivotal biasing force of said resiliently yieldable means pivots said retaining element in said direction about said axis, such that with said second panel in said closed position said bolt extending into said keeper forms a stop abutted by said retaining element under said axial biasing force of said resiliently yieldable means and maintaining said retaining element in said unarmed position, and such that upon movement of said second panel to said open position said bolt is withdrawn fron said keeper and from abutment with said retaining element and said axial biasing force of said resiliently yieldable means moves said retaining element axially along said aixs to said armed position.

14. An installation as claimed in claim 13, wherein said second panel is slidable relative to said first panel.

15. An installation as claimed in claim 13, wherein said axis is defined by a fixedly positioned member.

* * * * *